United States Patent [19]

Moody

[11] 4,203,605

[45] May 20, 1980

[54] FOOTBALL GAME

[76] Inventor: Joe W. Moody, 2306 W. 10th, Irving, Tex. 75060

[21] Appl. No.: 955,886

[22] Filed: Oct. 30, 1978

[51] Int. Cl.[2] ..... A63F 3/00; A63F 9/04

[52] U.S. Cl. ..... 273/247; 273/148 R

[58] Field of Search ..... 273/247, 281, 282, 287, 273/244, 144 R, 94, 268, DIG. 26, 148 R

[56] References Cited

U.S. PATENT DOCUMENTS

| | | | |
|---|---|---|---|
| 1,141,624 | 6/1915 | Fullerton | 273/94 R |
| 1,614,881 | 1/1927 | Conley | 273/94 R |
| 3,070,371 | 12/1962 | Hearle | 273/287 |
| 3,869,122 | 3/1975 | Payne, Jr. et al. | 273/94 R |

FOREIGN PATENT DOCUMENTS

| | | | |
|---|---|---|---|
| 1109135 | 1/1956 | France | 273/148 R |

*Primary Examiner*—Richard C. Pinkham
*Assistant Examiner*—Scott L. Brown
*Attorney, Agent, or Firm*—James E. Bradley

[57] ABSTRACT

A football game apparatus for simulating football. The game has a playing board surface with grid lines marked to define a playing field. Sliding markers indicate ball placement and the yardage required for first down. The game is played with dice to determine by chance the ball movement. A pair of cups are rotatably carried on the board surface. Each cup has an indicator to indicate various areas marked on the board surface. These areas indicate the next down and the play and must be selected by the players. The cups also receive the thrown dice, penalties being assessed if the dice bounce out, or if a player neglects to properly select his next play by rotating the cup.

8 Claims, 2 Drawing Figures

FOOTBALL GAME

BACKGROUND OF THE INVENTION

1. Field of the Invention

This invention relates in general to parlor type games, and in particular to a game simulating football.

2. Description of the Prior Art

Many parlor games simulating the American game of football have been proposed, as for example those shown in U.S. Pat. Nos. 4,003,580 and 3,869,122. These and other games have a playing board surface with grid lines simulating the football field. They also have sliding markers to indicate ball placement and the yardage required to make the first down. Usually the games are played with dice or cards, or both, to indicate ball movement. In some of the games, the rules are devised to allow strategy and skill to be involved. In all cases, the rules of the game seek to reproduce "live" football as much as possible.

One area in which they fail is in the area of penalties. Procedual penalties occur quite often during live football games due to inadvertent errors. As far is as known, the games proposed do not have any provisions wherein a player may inadvertently err, and be penalized for it.

SUMMARY OF THE INVENTION

It is accordingly a general object of this invention to provide an improved simulated football game apparatus.

It is a further object of this invention to provide an improved simulated football game apparatus in which penalties may be assessed against a player for procedual errors.

It is a further object to provide an improved simulated football game in which certain of the penalties assessed are due to actual player error and not due to chance.

In accordance with these objects, a simulated football game apparatus is provided that includes a game board surface with grid lines to simulate a football playing field. Markers to indicate ball placement and the yardage required for first down are slidably located in longitudinal grooves. A pair of selector cups are located in apertures in the board surface. These cups have an indicator and can be rotated. Various areas marked around the cup have indicia to indicate the down and play. The cups are fairly shallow and adapted to receive thrown dice. If the player inadvertently fails to rotate the selector cup to the proper position, a penalty may be assessed. If a die bounces out of the cup, a penalty is also assessed.

DESCRIPTION OF THE PREFERRED EMBODIMENT

Figure 1:
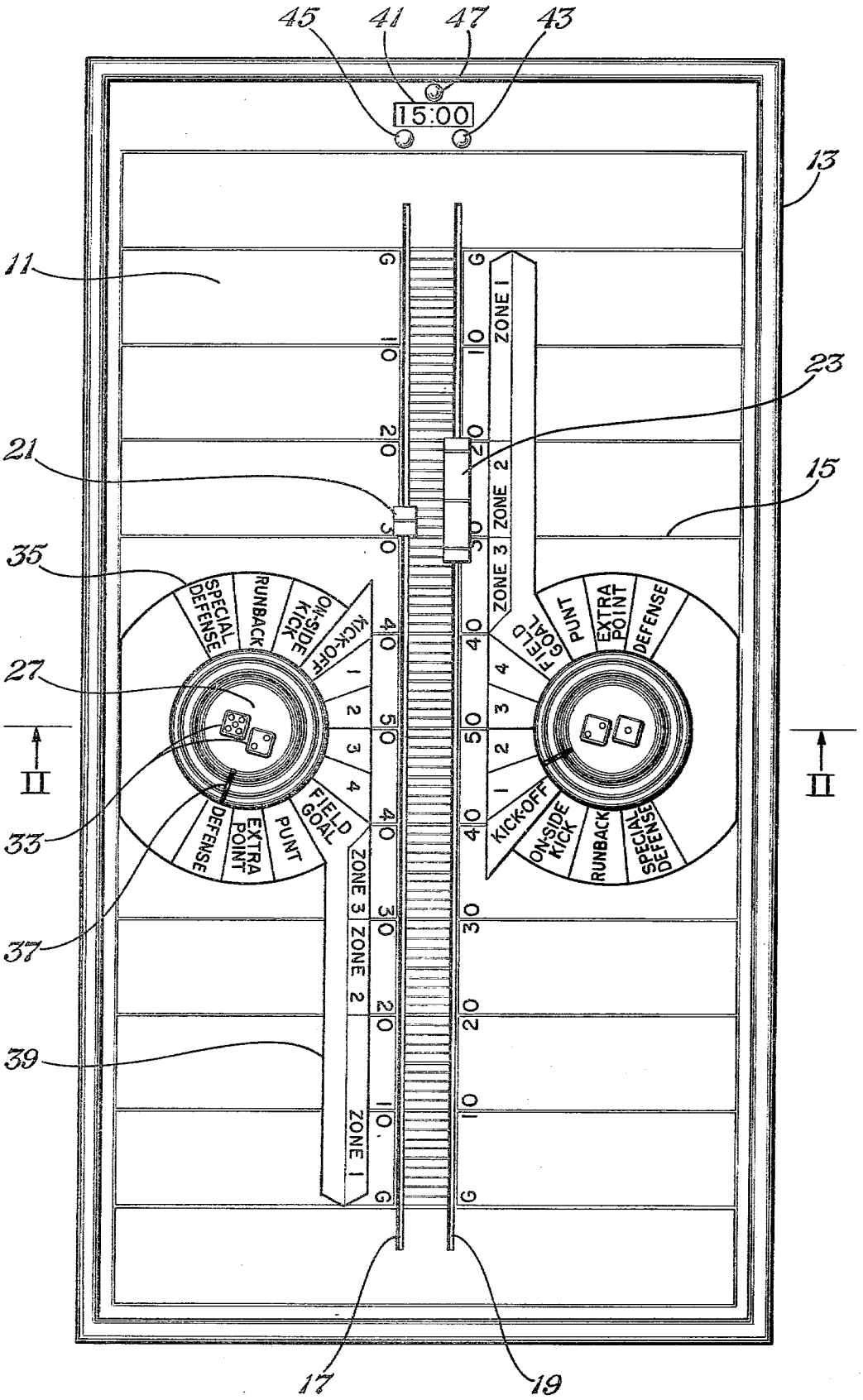
FIG. 1 is a top plan view of a football game constructed in accordance with this invention.

Referring to FIG. 1, the football simulating game apparatus includes a playing board 11 mounted to a rectangular frame 13. The surface of board 11 has markings thereon to simulate a football field, including eleven lateral lines 15 indicating 10-yard intervals and the goals at the ends.

Figure 2:
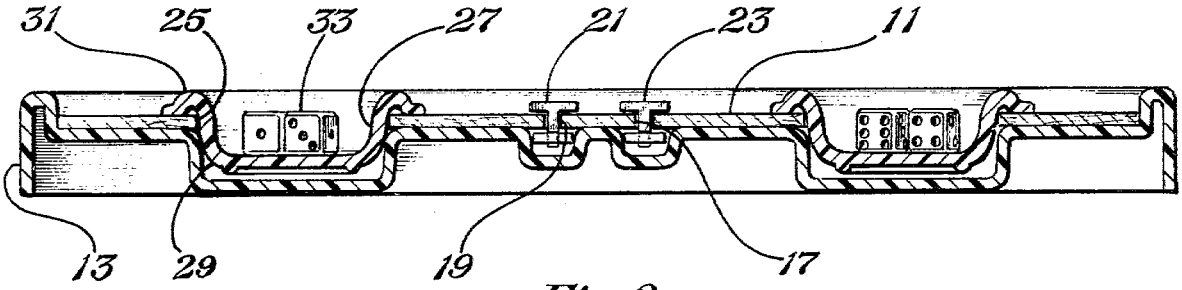
FIG. 2 is a sectional view of the football game of FIG. 1, taken along the line II-II.

As shown also in FIG. 2, two longitudinal grooves 17 and 19 formed in the board 11 extend the length of the field, intersecting the yard and goal lines 15. A ball marker 21 is slidably carried in grooves 17. Its position indicates the precise location of the football. A first down yardage marker 23 is slidably carried in groove 19. It has lines formed thereon 10 yards apart.

As shown also in FIG. 2, the board 11 has two apertures 25 formed therethrough at the longitudinal center, or on the 50-yard line. The apertures 25 are on opposite sides of grooves 17 and 19. A cup 27 is rotatably carried in each aperture 25. Cup 27 has a shallow generally cylindrical portion 29 and an outwardly protruding lip 31 at its mouth. The cylindrical portion 29 is of lesser diameter than aperture 25, while the lip 31 is larger. The height of cup 27 is less than the height of frame 13, allowing the lip 31 to support the cup. The diameter of the cup 27 is selected to accommodate an average size pair of dice 33.

Referring to FIG. 1, a series of markings 35 are formed on the surface of board 11 about each cup. These markings comprise radially extending lines located within a portion of a circle. The individual areas within these lines have indicia indicating plays and downs, as shown. The indicia around each cup are identical and include the words: "Special Defense;" "Runback;" "On-Side Kick;" "Kick-off;" "1;" "2;" "3;" "4;" "Field Goal;" "Punt;" "Extra Point;" and "Defense". Each cup has indicator means, preferably a line 37 formed on cup lip 31, to indicate which area has been selected by the rotation of the cup.

Additional markings 39 extend from the area marked "Field Goal" to the goal. This distance is 40 yards. Markings 39 comprise a straight strip divided into three zones marked "Zone 1," "Zone 2," and "Zone 3." Zone 1 extends from the goal to the 20-yard line. Zone 2 extends from the 20-yard line to the 30-yard line. Zone 3 extends from the 30-yard line to the 40-yard line.

Timer means for displaying elapsed time in reverse for simulating the time duration of the halves is mounted to one end of the board 11. The timer includes a clock 41 with a digital display that is preferably electrically powered and counts 15 minute intervals in reverse. The timer has a button switch 43 for starting the clock 41, a button switch 45 for stopping the clock, and a reset button 47 to reset to 15 minutes.

As shown in FIG. 2, the board 11 is preferably cardboard and rests in a depression formed in the frame 13. The frame 13 is preferably vacuum-formed plastic with depressions below apertures 25 and grooves 17 and 19.

In operation, the game is played with a pair of dice 33, one of which is white and the other colored a different color. For kick-off, the ball marker 21 is placed on the kicking team's 35-yard line. The selector cup 27 is rotated to indicate "Kick-Off." The clock 41 is set to 15 minutes and initiated. The kicking player rolls the dice, throwing them into his cup 27. The colored die is the lead die, and its reading is multiplied by ten and added to the exact value shown on the white die to determine the total yardage. For example if the color die shows five and the white die shows four, the ball is moved 54 yards, or to the 11-yard line. However, if the lead die shows a one or a two, a procedual penalty of five yards with a maximum of two successive penalties is incurred. After two such penalties, the kicking team rolls until a legitimate kick-off is executed. The ball marker 21 is moved to the position kicked.

The opposing player, for a runback, must have his selector on "Runback." He rolls both dice, and the ball is moved forward the exact yardage shown unless doubles are rolled. If doubles are rolled, the number is multiplied by 10. For example if double three's, the yardage is 30. Each and every time doubles are rolled, another roll is merited. A double six is considered a complete return for a touchdown.

After the runback, the first down yard marker 23 is positioned to indicate the distance required to make another first down. The player has four downs to make the ten yards. The offense player must rotate the selector cup 27 to the first down, which is the area 35 marked "1," while the defense must place his on "Defense." Either pass or running plays may be executed. If the offense player desires to make a running play, he rolls one die. A roll of one through five on this die merits the exact yardage shown, unless stopped by the defense as explained later. A roll of six merits a bonus roll each and every time a six is rolled. The offense must elect to keep the six, or go for more. Five straight sixes is a complete run to touchdown.

To defend the offensive running plays, the defender rolls both dice. He must roll a duplicate on the same color of the offense to stop for no gain. If the offense had rolled a six and had elected to roll more, then the defense can stop all of the yardage gained by the offense roll of six only by rolling a six himself, but of either color. For example if the offense rolled a six, elected to go for more, and rolls a four, the defense would need a six and a four to stop all yardage. A six and a two would stop the six, but not the four. A four and a three would stop the four but not the six. A double of an offense roll is a fumble recovery after yardage gain.

If the offense elected to make a pass play, again his selector cup must be on the correct down. He rolls both dice, and the yardage is that shown on the dice, unless doubles are rolled, then he may use multiples of ten. On doubles, the offense may elect to roll again or to keep the yardage that he has gained. A subsequent roll, however, increases the risk of incompletion, as explained hereinafter. A roll of double six by the offense is a touchdown play, unless the defense stops the play by an incompletion or interception as explained below.

To defend the passing plays, the defense must place his selector cup on "Defense." He rolls both dice. A duplicate of either offensive die stops the pass for an incompletion. An exact duplicate of both dice of the same color by defense is a quarterback sack, minus the number of yards shown. If the offense player had rolled doubles and elected to go for more, a duplicate of any dice rolled by the offense stops the pass as incomplete. Also a double of any dice rolled by the offense is an interception at the end of the yardage the play would have gained. A runback is then rolled by the intercepting player.

For field goal attempts, the offense must be within forty yards of the goal. He rotates the selector cup 27 to "Field Goal", and then rolls one die. If he is in "Zone 1," the point is good unless the defense duplicates the offense roll using the same color of die. If he is in "Zone 2," the offense must roll a two, three, four, or five to qualify. If he is in "Zone 3," the offense must roll a one or a six to qualify. A duplicate roll by the defense on the same color of die means that the field goal is missed, regardless of the zone. The defensive player always rolls one die to defense a field goal unless he is trying to block a field goal. This procedure is explained in the next paragraph under "Special Defense." There is a penalty procedure unless the defense rolls the same color of die.

For a punt, the selector must be placed on "Punt." Both dice are rolled and the lead die is multiplied by ten. If the colored die is a one or two, there is a procedual penalty of five yards against the kicking team with a maximum of two successive penalties. After two such penalty rolls in succession, the kicking team rolls until a legitimate kick-off is executed.

The defense may roll for a runback, under the rules previously discussed. Or in the case of punts and field goals, the defense may elect to attempt to block the kick. If so, he places the selector cup on "Special Defense." He rolls both dice, and if a double one or a double six is successfully rolled, the punt is blocked at the line of scrimmage and the defense may then roll a runback. If a block attempt fails, there is a 10-yard roughing the kicker penalty with an automatic first down.

In the case of a touchdown, the offense team has the opportunity for an extra point. The selector cup must be on "Extra Point," and one die is rolled. The point is good unless the defense duplicates the offense roll. Again the defense must be careful to roll the same color die as rolled by offense or there are penalties which apply.

For a kick-off, a player may elect to attempt an on-side kick. If so, the selector cup must be place on "On-Side Kick." The kicking team rolls both dice. A double one or a double six must be rolled, and if so, the kicking team has successfully recovered the kicked ball at the yardage down field the kick has traveled. For example, if a double one is rolled, the kick is recovered ten yards down field. If a double six is rolled, the kick is recovered twelve yards down field. If the on-side attempt fails, then the receiving team recovers the ball with no runback the exact number of yards shown on the kicking team dice, with no multiples of ten on the lead die.

Various penalties may be incurred for failing to have the selector cup in the correct position and failing to retain the dice in the cup. All penalties are subject to the election of the offended team. After the penalty is called, the offended team rolls and then either accepts the outcome of the play with loss of down or the penalty with resumption of down. For the offense, if it is a run or pass play and if the defense catches the offense with the selector cup out of the correct position, the penalty is 5-yards. It must be caught before the defense rolls. In any offense play, if a die bounces out of the cup, there is a procedual penalty of 5-yards.

For the defense, the same penalties apply for failing to have the cup on the right selector position. If the defense rolls the dice out of the cup on a pass play, it is considered a pass interference against the defense with an automatic first down with the yardage gained by the roll. For a run play, or kick-offs and punts, dice out of the cup is a 5-yard penalty. On a runback, dice out of the cup is a 15-yard clipping penalty from the point the runback starts.

The clock 41 controls the game, with it being reset at each half through reset 41. The ball is kicked off at the beginning of the second half. The clock is stopped and started by switches 43 and 45 for a certain number of time-outs.

It should be apparent that an invention having significant improvements has been provided. The football game accurately simulates live football in terms of scoring and ball movement. By penalizing a player for failing to rotate the selector cup and for failing to retain thrown dice in the cup, penalties are accurately simulated. The penalties are assessed for errors actually incurred by the players, not incurred by chance.

While the invention has been shown in only one of its forms, it should be apparent to those skilled in the art that it is not so limited but is susceptible to various changes and modifications without departing from the spirit thereof.

I claim:

1. In a simulated football game apparatus having a board with a simulated football field thereon, ball marker means, first down yardage indicator means, and a pair of dice for determining by chance movement of the ball, an improved selector means for indicating downs and plays, comprising:

a pair of cups rotatably carried by the board, one for the offense player and the other for the defense player; each cup being adapted to receive a die thrown by a player;

markings formed on the board about each cup defining areas containing indicia that indicate downs and plays; and indicator means on each cup for indicating which area has been selected by rotation of the cup, allowing penalties to be applied for failure to rotate the cup to the proper area before a play, and for failing to retain thrown dice in the cup.

2. The apparatus according to claim 1 wherein the cup has an outwardly protruding lip at its mouth, and wherein the indicator means comprises a line formed on the lip.

3. The apparatus according to claim 1 further comprising timer means for displaying elasped time in reverse for simulating the time duration of each football half.

4. A simulated football game apparatus, comprising:

a generally rectangular frame;

a board having yard lines defining a simulated football field carried by the frame; the board having a pair of longitudinal grooves extending along the length of the football field; the board having a pair of apertures;

a ball marker mounted slidably in one of the grooves to indicate the position of the ball;

a first down yardage marker mounted slidably in the other groove to indicate the yard line on the field that must be achieved in order to accomplish a first down;

the board having markings extending outward from each aperture that define areas containing indicia indicating the down and certain plays;

a pair of cups, each slidably carried in one of the apertures, each having a cylindrical portion with an outwardly protruding lip at the mouth, the cylindrical portion being of lesser diameter than the apertures and the lip being of greater diameter than the apertures to allow the lip to slidably support the cup, the height of the cup being less than the frame, each cup having an indicator line on the lip to selectively indicate the area selected; and a pair of dice for throwing into the cup to determine ball movement by chance, the rotatable cups allowing penalties to be assessed for failing to rotate the cup to the proper area before a play and for failing to retain thrown dice in the cup.

5. The apparatus according to claim 4 wherein the apertures are located on opposite side of the grooves and at the longitudinal center of the field.

6. The apparatus according to claim 4 wherein the areas include indicia indicating the down being played and whether the offensive play will be a field goal attempt or punt.

7. The apparatus according to claim 4 further comprising markings on the board dividing a selected distance from each goal into a plurality of field goal zones, each one requiring a different roll of dice in order to score a goal.

8. The apparatus according to claim 4 further comprising timer means for displaying elasped time in reverse for simulating time duration of the halves.

* * * * *